United States Patent [19]

Nishide et al.

[11] 4,114,021

[45] Sep. 12, 1978

[54] HEAT ROLL FIXING DEVICE FOR ELECTROPHOTOGRAPHIC COPYING MACHINE

[75] Inventors: Hiroo Nishide; Yasuhiro Uehara, both of Ebina, Japan

[73] Assignee: Rank Xerox, Ltd., London

[21] Appl. No.: 801,678

[22] Filed: May 31, 1977

[51] Int. Cl.[2] ..... H05B 1/00

[52] U.S. Cl. ..... 219/216; 219/388; 219/469; 432/60

[58] Field of Search ..... 219/216, 388 W, 469–471; 432/60, 228; 355/3 FU

[56] References Cited

U.S. PATENT DOCUMENTS

| | | | |
|---|---|---|---|
| 3,356,831 | 12/1967 | Andrus et al. | 219/216 X |
| 3,811,821 | 5/1974 | Ariyama et al. | 432/228 |
| 4,001,546 | 1/1977 | Johnson, Jr. et al. | 219/216 |

*Primary Examiner*—C. L. Albritton

[57] ABSTRACT

A heated roll fixing device for electrophotographic copying machines, wherein said device is provided with a first roll 4 which is coated on the surface with a heat-resistant releasing agent 2, said first roll being adapted to contact toner images 6 on a supporting body 7. A second roll 5 cooperating with said first roll 4 for pressure-heat-fixing the toner images to said supporting body 7. The fixing device is characterized in that either said first roll 4 or second roll 5 but at least said first roll 4 is provided with an inner heating means 3, and an outer heating means 13 with small heat capacity is provided in a manner to surround said first roll 4 as illustrated in FIG. 4 of the drawings.

4 Claims, 4 Drawing Figures

HEAT ROLL FIXING DEVICE FOR ELECTROPHOTOGRAPHIC COPYING MACHINE

BACKGROUND OF THE INVENTION

This invention relates to a heated roll fixing device for use in an electrophotographic copying machine.

Conventionally, a fixing device for electrophotographic copying machines which has been widely used is a heated roll fixing device.

Such a heated roll fixing device, for example, is of the type, as shown in FIG. 1, in which there are provided a heated roll 4 which is provided with a heating element such as infrared ray lamp which serves as an inner heating means 3 on the shaft portion of the roll, which roll is coated around a core 1 made of copper or aluminum with heat-resistant surface lubricants such as tetrafluoroethylene resin, silicone rubber, fluorocarbon resin or the like, and a pressure roll 5 which is rotated in cooperation with said heated roll 4. A supporting body 7 carrying unfixed thermoplastic powders (hereinafter referred to as "toner") in image configuration is passed between said rolls 4 and 5.

The heated roll fixing device of such a construction has such advantages that it is operated under relatively low electric power and that it has little or no chance of causing fire and the like.

Also, the heated roll fixing device employing a heat roll coated with silicone rubber as a heat-resistant surface lubricant generally has been widely used, because such device provides an appropriate contact width under relatively low electric power, and since the roll surface is soft, toner images on the supporting body are never crused, whereby copies of high quality are produced.

However, since rubber material is thermally insulative to a high degree, it is necessary to increase the inner temperature (the temperature of internal heating means) to a considerable degree in order that the surface of the heat roll may have a desirable surface temperature.

This, however, exerts adverse influence on the connection or bond between the inner surface of the coated rubber layer and the outer surface of the core and at the same time it leads to the deterioration of the rubber material.

Such phenomenon is clearly seen when supplying offset prevently liquid such as silicone oil on the roll.

In order to reduce the difference between the inner temperature and the surface temperature, it is effective to reduce the thickness of the rubber layer as much as possible. However, there, of course, exists a limit in reducing the thickness, it is difficult to solve the aforesaid problem by doing this.

To overcome this, it has already been proposed to provide an outer heating means.

As an example which has already been devised, there is a heated roll fixing device, as shown in FIG. 2, of the type, in which an outer heat roll 8 (hereinafter referred to as a third roll), which is rotated in contactwith the heated roll 4 and is maintained at high temperature, is provided for heating the heated roll 4.

However, with such a construction, since the third roll 8 has a large heat capacity, it is necessary to rotate the heated roll 4 even during the wait time between the production of a copy and the next copy (hereinafter referred to as pre-heat time) so that only a part of the heated roll 4 is not heated. In other words, the heated roll 4 is heated substantially uniformly by the third roll 8. Further, as the area of the rolls 4, 5 and 8 becomes large in total, the quantity of heat to be discharged also becomes large. In other words, the quantity of heat to be effectively discharged for cleaning is reduced with the result of increased heat loss. In addition, the toner particles which are offset on the heated roll 4 are likely to be transferred onto the third roll.

Another example which has already been proposed (devised) is shown in FIG. 3, wherein the heat roll 4 is provided on the surface thereof with an infrared ray lamp 9 so that said heated roll may be heated.

However, with such construction, there exists a fear of causing fire since the infrared ray lamp 9 has high temperature. This eliminates such an advantage of the heat roll fixing device that there is no fear of causing fire, and at the same time there occur irregularities in the surface temperature of the rolls, thereby resulting in an inefficiently heated roll fixing device.

It is therefore an object of the present invention to provide a novel heat roll fixing device for electrophotographic copying machines employing a heated roll coated with heat-resistant releasing agent, in which there are provided in combination an inner heating means, such as, an infrared ray lamp, and an outer heating means with small heat capacity, thereby maintaining various advantages of a heat roll fixing device as well as improving a heated roll fixing device which has already been proposed and is provided with an outer heating means.

Another object of the present invention is to provide a heated roll fixing device for electrophotographic copying machine, which is free from the above-described drawbacks as experienced in the known device.

BRIEF DESCRIPTION OF THE DRAWINGS

Other advantages and objects of the invention will become apparent when read in conjunction with the accompanying drawings wherein.

DETAILED DESCRIPTION OF THE PREFERRED EMBODIMENT

Figure 1:
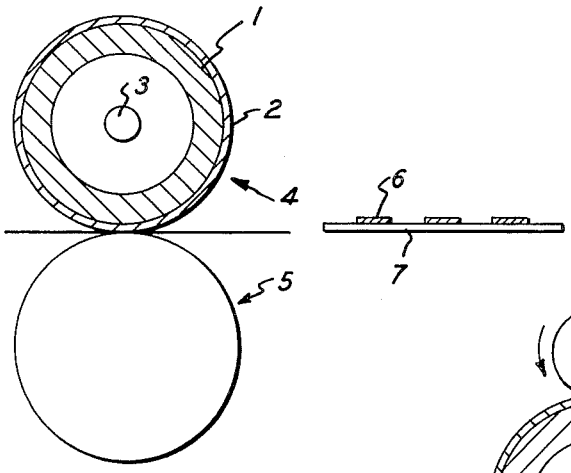
PRIOR ART FIG. 1
FIG. 1 is a schematic view of a heated roll fixing device of generally known construction.
Figure 2:
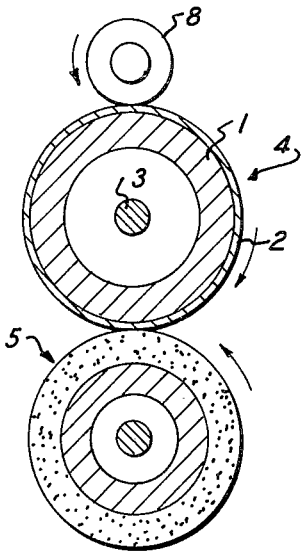
PRIOR ART FIG. 2
FIG. 2 is a schematic view of a heated roll fixing device employing an outer heat roll.
Figure 3:
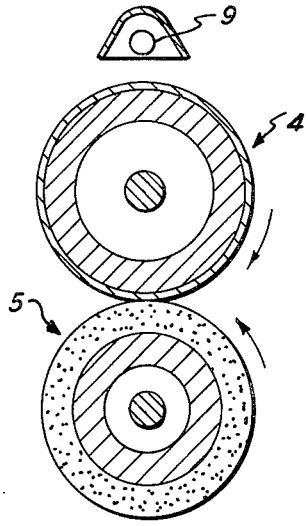
PRIOR ART FIG. 3
FIG. 3 is a schematic view of a heated roll fixing device which is provided with an infrared ray lamp for heating the heat roll.

The present invention will now be described in more detail with reference to FIG. 4 which shows, by way of example, an embodiment of the invention for facilitating understanding of the invention, in which the same members as those of conventional ones are expressed by the same reference numerals.

Figure 4:
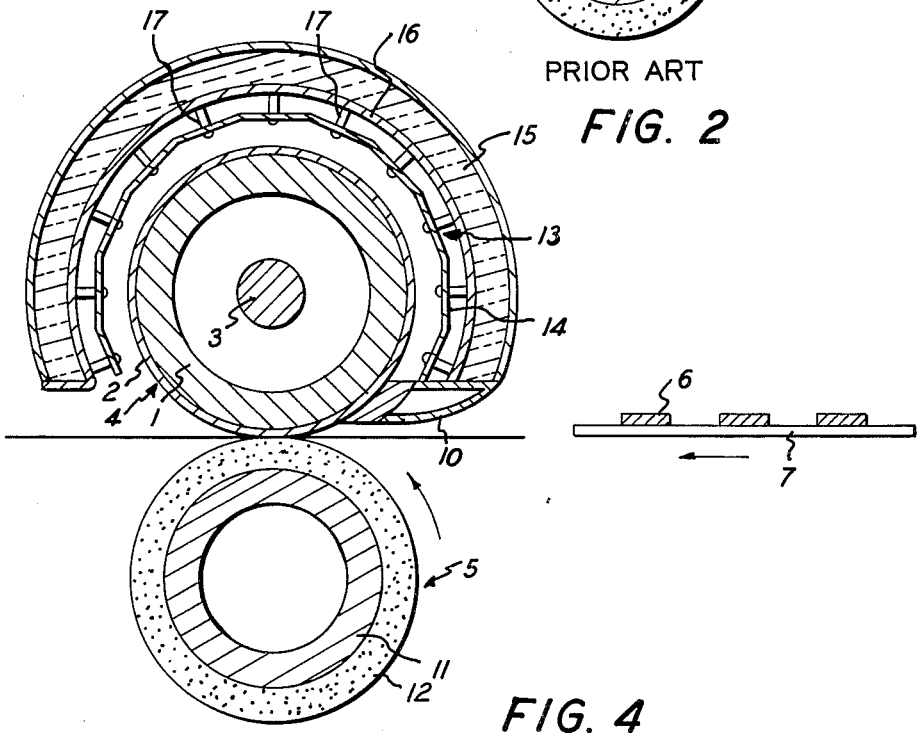
FIG. 4 is a cross-sectional explanatory view of an embodiment of the present invention.

In FIG. 4, shown at 4 is a heated roll which is adapted to contact toner images 6 on a supporting body 7. The heat roll is formed by coating a silicone rubber 2 of 0.5 mm in thickness on the outer periphery of copper core 1 of 3 mm in thickness and 40mm in diameter. Said heat roll is provided on the center thereof with an inner heating means 3 such as infrared ray lamp and is provided on the surface thereof with a temperature detector 10 for controlling the surface temperature of the roll.

Shown at 5 is a pressure roll, which roll is formed by coating a silicone rubber 12 or 10 mm in thickness on the outer periphery of a core 11 made of aluminum.

If necessary, offset preventing liquid such as silicone oil may be supplied to the heated roll 4 or the pressure roll 5.

Defined at 13 is an outer heating means of low heat capacity which is provided in a manner to surround the heat roll 4 without contacting said roll. In the embodiment as illustrated, a plurality of heating elements of small heat capacity, which are in small thin-plate form, are provided in a manner to surround the internally heated roll 4. The heater 13 is hereinafter referred to as plane heater. The heating elements 14 of said plane heater are rigidly secured to a reflecting plate 16 made of polished stainless, steel said plate being provided on the inner surface of a heat insulating material 15 of semi-cylindrical form surrounding the heat roll 4, through supporting means 17 made of ceramic. The surface of each of said heating elements 14 at the side of the heat roll 4 is subjected to black treatment for emitting heat efficiently.

The plane heater 13 as shown in FIG. 4 consists of the ten heating elements 14 which are connected in series with each other, said elements being made of nichrome of 12mm in width, 400mm in length and 30mm in thickness, and has extremely small heat capacity of about 8 joule/° C.

In the embodiment as mentioned above, the roll surface temperature necessary for conducting a desired fixing is 150° C and it is always necessary to maintain the surface temperature of roll at 150° C – 160° C even during the time of pre-heating when effecting fixing solely by means of the inner heating means 3 of infrared ray lamp.

However, with the outer heating means 13 as described in the embodiment, if the surface temperature of the roll is maintained at 130° C. during the time of pre-heating and electric power is adapted to be applied to the plane heater when pushing a print button, the temperature of the plane heater is immediately increased, so that the surface temperature of the heat roll 4 is increased up to 150° C in a few seconds until the supporting body 7 reaches to the heated roll fixing device.

In accordance with the above, the appropriate surface temperature of plane heater necessary for increasing the surface temperature of the heat roller 4 up to 150° C in a few seconds is 200° C to 350° C. Since the heat capacity of the plane heater is 8 joule/° C, which is extremely small, the surface temperature of the plane heater can be increased up to 250° C to 350° C in the period of time required.

In addition, when the applied voltage of the plane heater is cut off as soon as the supporting body 7 is passed through the heated roll fixing device, since the heat capacity of the plane heater is extremely small of 8 joule/° C and thus residual heat of the plane heater is small, the rubber surface is not damaged at all even if the rotation of the heated roll 4 is terminated.

Further, if the supporting body 7 winds around the heat roll 4, since the temperature of the plane heater is low and the quantity of the residual heat is small, it can be prevented to cause fire by immediately cutting off the power supply from the plane heater.

As is apparent from the foregoing description, according to the invention, the outer heating means 13 with extremely small heat capacity is provided for heating the first roll 4 in a short time, so that the temperature of the first and second roll 4 and 5 during the time of pre-heating can be lowered to the temperature which is lower than that necessary for fixing and it is unnecessary to use the outer heating means 13 during the time of pre-heating.

Accordingly, the adhesives for bonding the rubber layer 2 (silicone rubber) of the first roll 4 and the core 1 during the time of pre-heating as well as the rubber layer 1 (silicone rubber) can be prevented from being deteriorated to a considerable degree. Also, the first roll 4 can be stopped during the time of pre-heating.

Furthermore, as the inner heating means 3 and the outer heating means 13 are used in combination for heating the roll the supporting body 7 passes through the roll, the temperature of the bonding agent at the bonding portion of the rubber layer 2 (silicone rubber) and the core 1 can be lowered, thereby minimizing the deterioration of the bonding agent as well as the rubber layer 2 (silicone rubber) to a considerable degree and reducing power consumption.

With the outer heating means 13 having low heat capacity, the amount of the residual heat is small, and as the temperature of the outer heating means 13 itself is low, even if the supporting body 7 winds around the first roll 4, it can be prevented to cause fire only by stopping the outer heating means 13.

A further advantage of the invention is that as the outer heating means is not in contact with the roll 4, the roll surface is not injured and damages by offset of toner are eliminated.

What is claimed is:

1. Fuser apparatus for fixing toner images to copy substrates, said apparatus comprising:

a first roll member;

a second roll member cooperating with said second roll member to form a nip through which said copy substrates pass with said toner images contacting said first roll member;

first heating means disposed internally of said first roll member for elevating the surface temperature thereof to a first predetermined level;

second heating means disposed externally of said first roll member and adjacent thereto, said second heating means comprising a low heat capacity element which can be elevated to a second predetermined temperature which is higher than said first predetermined temperature, said elevation of said second heating means being capable of being effected in a very short period of time whereby the surface of said first roll member can be quickly raised to its operating temperature by virtue of the thermal energy supplied by both said first and second heating means said second heating means being coextensive with more than half the surface of said first roll member.

2. Apparatus according to claim 1 including a reflector support such that said second heating means is interposed between said reflector and said first roll member.

3. Apparatus according to claim 2 including heat retarding means for minimizing the loss of heat said heat retarding means being disposed adjacent said second heating means and being coextensive therewith.

4. Apparatus according to claim 3 wherein the surface of said second heating means adjacent said first roll member is treated in order to enhance the thermal properties thereof.

* * * * *